US006710777B1

(12) United States Patent
Chun et al.

(10) Patent No.: US 6,710,777 B1
(45) **Date of Patent: *Mar. 23, 2004**

(54) METHOD AND APPARATUS IN A DATA PROCESSING SYSTEM FOR INSTALLING APPROPRIATE WID VALUES FOR A TRANSPARENT REGION

(75) Inventors: Sung Min Chun, Austin, TX (US); Richard Alan Hall, Round Rock, TX (US); George Francis Ramsay, III, Cedar Park, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/478,302

(22) Filed: Jan. 6, 2000

(51) Int. Cl.[7] ..... G09G 5/39
(52) U.S. Cl. ..... 345/545; 345/626; 345/629
(58) Field of Search ..... 345/501, 538, 345/539, 545, 546, 626, 629

(56) References Cited

U.S. PATENT DOCUMENTS

| | | | | | |
|---|---|---|---|---|---|
| 5,046,042 | A | * | 9/1991 | Nitatori et al. | 710/60 |
| 5,604,518 | A | * | 2/1997 | Flaker et al. | 345/199 |
| 5,629,723 | A | * | 5/1997 | West et al. | 345/201 |
| 5,801,705 | A | * | 9/1998 | Kato et al. | 345/419 |
| 5,831,638 | A | * | 11/1998 | West et al. | 345/501 |
| 5,854,628 | A | * | 12/1998 | Nakagawa | 345/803 |
| 5,874,967 | A | * | 2/1999 | West et al. | 345/435 |

* cited by examiner

*Primary Examiner*—Matthew C. Bella
*Assistant Examiner*—Mackly Monestime
(74) *Attorney, Agent, or Firm*—Duke W. Yee; Mark E. McBurney

(57) ABSTRACT

A method and apparatus in a data processing system for updating a buffer containing display information used to display pixels from a first layer and a second layer on a display in the data processing system. Pixels from the first layer and pixels from the second layer are identified in a transparent region. The display information is updated in the buffer for pixels in the first layer in the transparent region. Correct display information is assigned to pixels in the second layer in the transparent region.

27 Claims, 8 Drawing Sheets

WID COLOR BUFFER

```
666611111111111
666611155555111
777771155555111
777771155555111
777771155555111
777771111111111
```

WID OVERLAY BUFFER

```
001111111222222
001111111000222
221111111000222
222222200000222
222222200000222
222222222222222
```

SCREEN

```
661111111222222
661111111555222
221111111555222
222222255555222
222222255555222
222222222222222
```

4 BIT WID BUFFER

```
661111111222222
661111111555222   500
221111111555222
222222255555222
222222255555222
222222222222222
```

400

| COLOR WAT | | | | | | OVERLAY WAT | | |
|---|---|---|---|---|---|---|---|---|
| WID | PIXEL TYPE | COLORMAP | BUFFER | GAMMA | | PIXEL TYPE | COLORMAP | TRANSPARENT |
| 0 | | | | | | 8 | 0 | 2 |
| 1 | | | | | | 8 | 2 | 2 |
| 2 | | | | | | 8 | 3 | 2 |
| 3 | | | | | | 8 | 1 | 2 |
| 4 | | | | | | 8 | 2 | 2 |
| 5 | 8 | 0 | 0 | | | 8 | 4 | 1 |
| 6 | 8 | 4 | 0 | | | 8 | 4 | 1 |
| 7 | 24 | 3 | 0 | | | 8 | 4 | 1 |
| 8 | 24 | 2 | 0 | | | 8 | 4 | 1 |
| 9 | 8 | 1 | 0 | | | 8 | 4 | 1 |
| a | 8 | 4 | 0 | | | 8 | 4 | 1 |
| b | 8 | 4 | 0 | | | 8 | 4 | 1 |
| c | 8 | 3 | 0 | | | 8 | 4 | 1 |
| d | 8 | 2 | 0 | | | 8 | 4 | 1 |
| e | 24 | 1 | 0 | | | 8 | 4 | 1 |
| f | 8 | 0 | 0 | | | 8 | 4 | 1 |

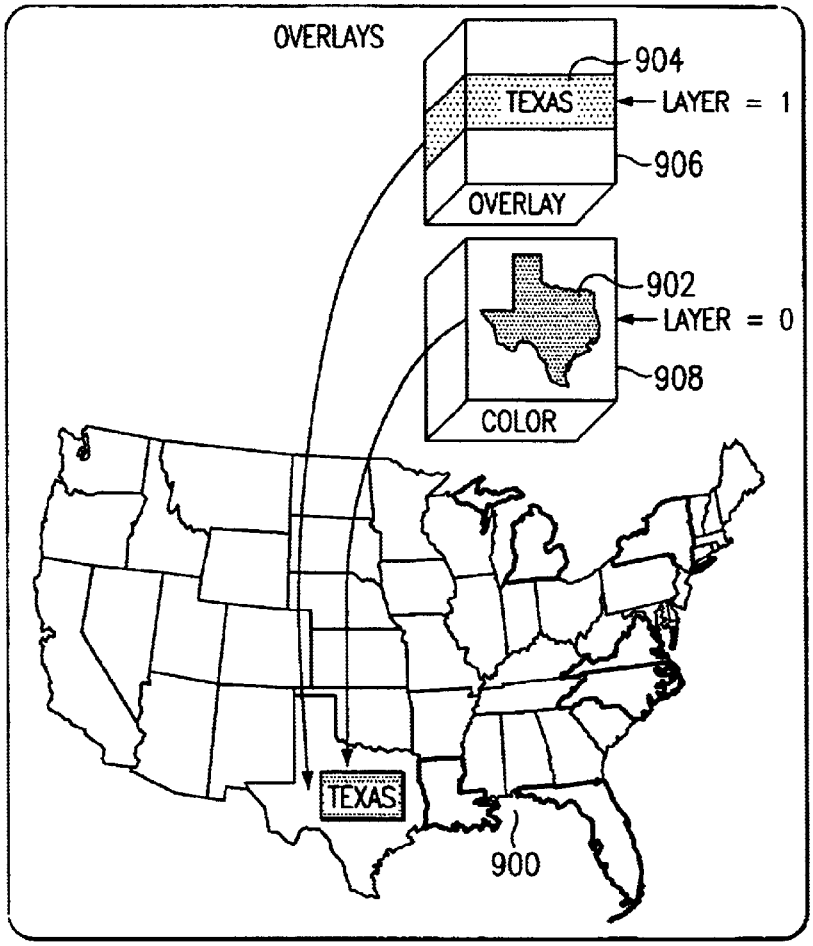
FIG. 9
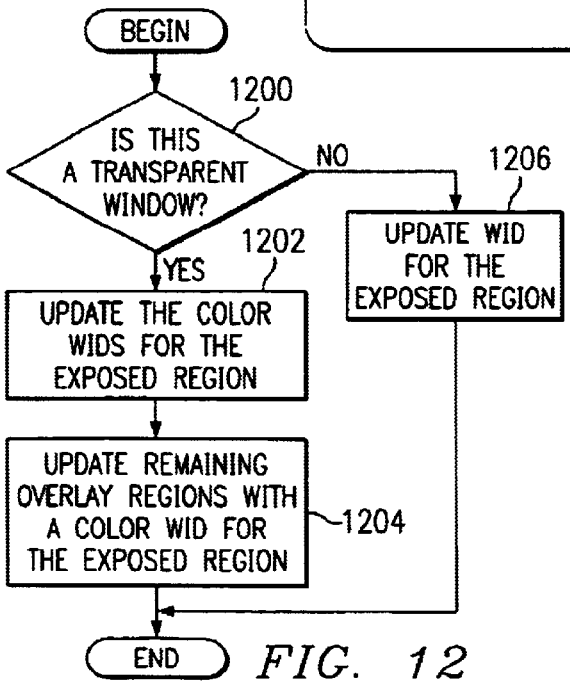
FIG. 12
4 BIT WID BUFFER
```
6611111 1ffffffff
6611111 15555fff   1002
2211111 15555fff
2222222 55555222
2222222 55555222   1000
2222222 22222222
```
FIG. 10

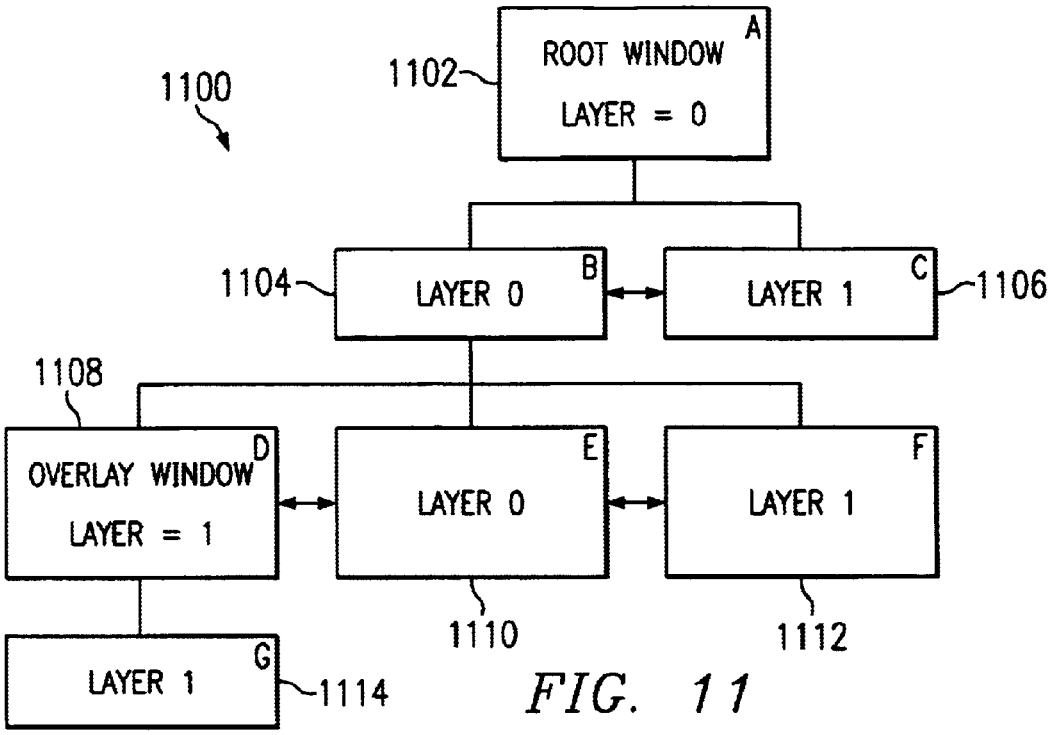

FIG. 11

1400

```
/*-----------------------------------------
  If it is a transparent WID (0xffff),
  then call UpdateColorWIDS to update
  the color wids. If there are any
  regions that have not been updated to a
  color wid, assign MAX_COLOR_WID_VALUE
  so the transparent region will have the
  correct colormap.
  -----------------------------------------*/

if (pVWID->WID == 0xffff) {
   (* pScreen->RegionCopy) (&tmpExposed,&pVWID->exposed);
   UpdateColorWIDS(pScreen,&tmpExposed,pWinRoot);
   (* pScreen->Intersect)
    (&tmpExposed,&tmpExposed,&pScreen->layers[0].unownedList);
   UpdateWIDPlanes(pScreen, 0,&tmpExposed,MAX_COLOR_WID_VALUE);
}
```

FIG. 14

1500

```
/*****************************************************************************
**
* NAME:      UpdateColorWIDS
*
*
*
* IN: region
*
*     pWin
*
*
*
* Description: This function will update all Color WIDS that intersect
*
* region. This function traverses pWin and all of its
*
* siblings and children
*
*****************************************************************************
**/

void UpdateColorWIDS(pScreen,region,pWin)
ScreenPtr pScreen;
RegionPtr region;
WindowPtr pWin;
{
  RegionRec              dRegion;
  aixddxWindowPrivPtr    pAixPrivWin;
  gWinGeomPtr            pWinGeom;
  winPrivPtr             pPrivWin;
  int                    flag;

  if(!pWin){
     return;
```

FIG. 15A

1500

```
}else{
   if(!pWin->layer && pWin->mapped) {
      (* pScreen->RegionInit) (&dRegion, (BoxPtr)NULL,0);

      if (pWin->borderWidth) {
         (* pScreen->Subtract)     (&dRegion, &pWin->borderClip,
                                   &pWin->winSize);
         (* pScreen->Union)        (&dRegion, &dRegion,
                                   &pWin->clipList);
         (* pScreen->Intersect)    (&dRegion, region, &dRegion);
      }
      else {

         (* pScreen->Intersect) (&dRegion, region, &pWin{clipList);
      }
      if( (* pScreen->RegionNotEmpty ) (&dRegion) ) {
         pPrivWin = GET_WIN_PRIV(pWin);

         pAixPrivWin = (aixddxWindowPrivPtr)GET_aixWIN_PRIV(pWin);
         if (pAixPrivWin->i_am_dwa) {
           pWinGeom = pPrivWin->pGaiWinGeom;
           flag     = gCWwinOrg | gCWwidth | gCWheight |
                      gCWclip | gCWvisibility;
           aixLockAdapter(pScreen) (pScreen->myNum);
           (* pWinGeom->pProc->UpdateWinGeom) (pWinGeom, flag);
           aixUnlockAdapter(pScreen) (pScreen->myNum);

         }else{
           UpdateWIDPlanes( pScreen, pWin->layer,
                            &dRegion, pPrivWin->pVWID->WID);
         }
      } /* if( (* pScreen->RegionNotEmpty ) (&dRegion) )*/

      (* pScreen->RegionDestroy) (&dRegion);

   }/* if(!pWin->layer) */

   pWin = pWin->firstChild;

  while(pWin) {
   UpdateColorWIDS(pScreen,region,pWin);
   pWin = pWin->nextSib;
  }
 } /* if(!pWin) */
}
```

FIG. 15B

METHOD AND APPARATUS IN A DATA PROCESSING SYSTEM FOR INSTALLING APPROPRIATE WID VALUES FOR A TRANSPARENT REGION

CROSS REFERENCE TO RELATED APPLICATIONS

The present invention is related to applications entitled METHOD AND APPARATUS FOR UPDATING A WINDOW IDENTIFICATION BUFFER IN A DATA PROCESSING SYSTEM; serial no. 09/478,304, filed Jan. 6, 2000; and METHOD AND APPARATUS IN A DATA PROCESSING SYSTEM FOR UPDATING COLOR BUFFER WINDOW IDENTIFIERS WHEN AN OVERLAY WINDOW IDENTIFIER IS REMOVED, serial no. 09/478,303, filed Jan. 6, 2000; assigned to the same assignee, and incorporated herein by reference.

BACKGROUND OF THE INVENTION

1. Technical Field

The present invention relates generally to an improved data processing system and in particular to a method and apparatus for displaying pixels in a data processing system. Still more particularly, the present invention provides a method and apparatus for installing the correct wid values for a transparent region.

2. Description of Related Art

Computer graphics concerns the synthesis or display of real or imaginary objects from computer-based models. In computer graphics systems, images are displayed on a display device to a user in two dimensional and three dimensional forms. These images are displayed using pixels. A pixel is short for a picture element. One spot in a rectilinear grid of thousands of such spots that are individually "painted" to form an image produced on the screen by a computer or on paper by a printer. A pixel is the smallest element that display or print hardware and software can manipulate in creating letters, numbers, or graphics. These pixels and information relating to these pixels are stored in a buffer. The information describing a pixel is identified using a window ID (WID). A WID is used as an index into a window attribute table (WAT). The WAT contains information describing how a pixel will be displayed on the screen. For example, a WAT identifies depth, color map, buffer, and gamma for a pixel.

Typically, the WID is drawn into a separate buffer, which is used to describe how the pixels in the frame buffer or buffers will be rastered. Some graphic systems, such as, for example, UNIX servers, use overlays to enhance the performance of three dimensional applications, which need to be overlaid on top of a three dimensional application. An example of such is a menu. These type of servers typically require a separate WID buffer for the color planes and overlays to allow for the WIDs to be saved and restored. In FIG. 1, an example of data in a portion of a WID color buffer is illustrated. FIG. 2 is an example of data in a portion of a WID overlay buffer. In these two examples, each of the numbers illustrates a WID, which is used as an index into a WAT to identify information used to display a pixel associated with the WID. In FIG. 2, a zero is used to indicate that the overlay is disabled.

Typically, an eight bit split WID may be identified in hardware in which three bits are used to identify the WID for the overlay buffer and in which five bits are used to identify the WID for the color buffer. For example, the first three bits are used as an index into an overlay WAT while the lower five bits are used as an index into a color WAT. With three bits, eight WID entries may be identified or assigned to a pixel using the WID overlay buffer. Thirty-two different WID entries may be assigned to pixels using the WID color buffer. In this manner, a WID for a color buffer may be painted to the frame buffer without overwriting the WID in the overlay buffer. FIG. 3 illustrates resulting WIDs that would be used to display pixels displayed on a screen. Each of the WIDs identifies what pixels and from what buffer the pixels will be retrieved for display.

In manufacturing graphics chips, it is cheaper to fabricate a graphics chip without split WIDs. In such a case, only one WID buffer and two frame buffers are required. Some color graphic adapters support multiple color maps. For example, if a graphics adapter supports four color maps, a total of four color maps may be displayed on the screen at any one time. Without split WIDs, the number of bits available are reduced. For example, a non-split WID graphics chip may support only four WID bits. It is desirable to maximize the total number of WIDs using these four WID bits. In such a case, no WID is associated for transparency. This setup allows a window with a transparent visual to be displayed without using a WID. In FIG. 4, a WAT table is illustrated for a color WAT and an overlay WAT. Table 400 is an example of a WAT for a four bit WID system. WIDs 0–4 are used for opaque overlay WIDs, while WIDs 5–15 are used for color plane WIDs and for transparency for the transparent visual. In this example, each WID also includes an identification of a color map, as well as pixel type, buffer location of the pixel, and gamma. In FIG. 5, a portion of a four bit WID buffer is illustrated. Transparent region 500 includes WIDs 1, 2, and 5. Using WAT 400 in FIG. 4, WID 5 contains the correct color map slot of 4 for the transparent overlay. WID 1 and WID 2 are opaque overlay WIDs using WID table 400. For these WIDs, the WID values are incorrect and will produce incorrect color map slots of 2 and 3 for these portions of the transparent window. The WID values are correct for part of transparent region 500 and incorrect for other parts of transparent region 500 in FIG. 5. As can be seen, the problem associated with such an architecture creates problems in using the correct WID values which will in essence contain the correct color map and be transparent.

Therefore, it would be advantageous to have an improved method and apparatus for installing a correct WID values over an entire transparent region.

SUMMARY OF THE INVENTION

The present invention provides a method and apparatus in a data processing system for updating a buffer containing display information used to display pixels from a first layer and a second layer on a display in the data processing system. A transparent region containing pixels from the first layer and pixels from the second layer is identified. The display information is updated in the buffer for pixels in the first layer in the transparent region. Correct display information is assigned to pixels in the second layer in the transparent region.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 9 is an illustration of an overlay in accordance with a preferred embodiment of the present invention;

FIG. 10 is a diagram illustrating a portion of a four bit WID buffer in accordance with a preferred embodiment of the present invention;

FIG. 11 is a diagram illustrating a window tree in accordance with a preferred embodiment of the present invention;

FIG. 12 is a flowchart of a process for installing correct WIDs over an entire transparent region in accordance with a preferred embodiment of the present invention.

FIG. 14 is a diagram of code used to update color WIDs in a transparent window region in accordance with a preferred embodiment of the present invention; and FIGS. 15A and 15B are diagrams illustrating an updated color WID function in accordance with a preferred embodiment of the present invention.

DETAILED DESCRIPTION OF THE PREFERRED EMBODIMENT

Figures 1, 2, 3, 5, 6:
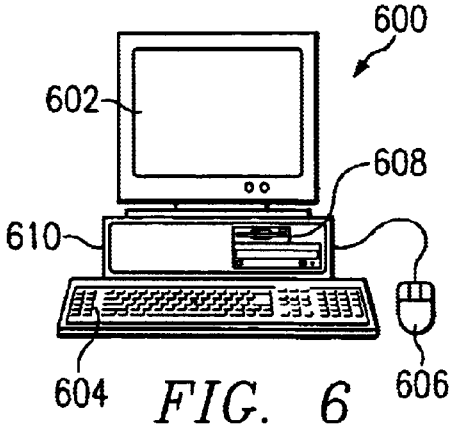
FIG. 1 (PRIOR ART)
FIG. 2 (PRIOR ART)
FIG. 3 (PRIOR ART)
FIG. 5 (PRIOR ART)
FIG. 1 is an example of data in a portion of a WID color buffer is illustrated.
FIG. 2 is an example of data in a portion of a WID overlay buffer.
FIG. 3 illustrates resulting WIDs that would be used to display pixels displayed on a screen.
FIG. 5 is a portion of a four bit WID buffer is illustrated.
FIG. 6 is a pictorial representation of a data processing system in which the present invention may be implemented in accordance with a preferred embodiment of the present invention.

With reference now to the figures and in particular with reference to FIG. 6, a pictorial representation of a data processing system in which the present invention may be implemented is depicted in accordance with a preferred embodiment of the present invention. A computer 600 is depicted which includes a system unit 610, a video display terminal 602, a keyboard 604, storage devices 608, which may include floppy drives and other types of permanent and removable storage media, and mouse 606. Additional input devices may be included with personal computer 600. Computer 600 can be implemented using any suitable computer, such as an IBM RS/6000 computer or IntelliStation computer, which are products of International Business Machines Corporation, located in Armonk, N.Y. Although the depicted representation shows a computer, other embodiments of the present invention may be implemented in other types of data processing systems, such as a network computer. Computer 600 also preferably includes a graphical user interface that may be implemented by means of systems software residing in computer readable media in operation within computer 600.

Figure 7:
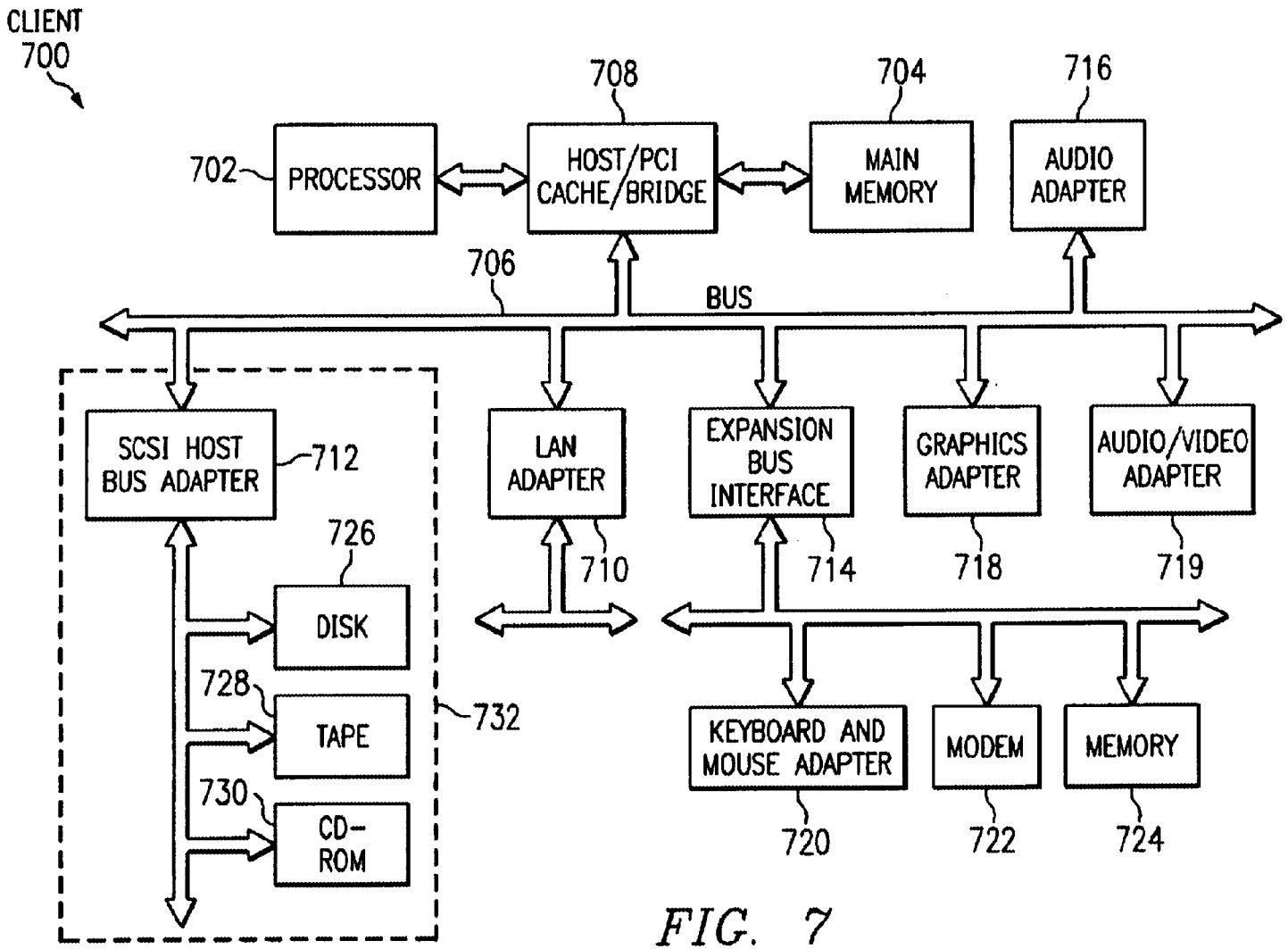
FIG. 7 is a block diagram illustrating a data processing system in which the present invention may be implemented.

With reference now to FIG. 7, a block diagram illustrating a data processing system in which the present invention may be implemented. Data processing system 700 is an example of a computer, such as computer 600 in FIG. 6, in which code or instructions implementing the processes of the present invention may be located. Data processing system 700 employs a peripheral component interconnect (PCI) local bus architecture. Although the depicted example employs a PCI bus, other bus architectures such as Accelerated Graphics Port (AGP) and Industry Standard Architecture (ISA) may be used. Processor 702 and main memory 704 are connected to PCI local bus 706 through PCI bridge 708. PCI bridge 708 also may include an integrated memory controller and cache memory for processor 702. Additional connections to PCI local bus 706 may be made through direct component interconnection or through add-in boards. In the depicted example, local area network (LAN) adapter 710, small computer system interface SCSI host bus adapter 712, and expansion bus interface 714 are connected to PCI local bus 706 by direct component connection. In contrast, audio adapter 716, graphics adapter 718, and audio/video adapter 719 are connected to PCI local bus 706 by add-in boards inserted into expansion slots. The processes of the present invention may be used to manage rendering of data by graphics adapter 718 or audio/video adapter 719.

Expansion bus interface 714 provides a connection for a keyboard and mouse adapter 720, modem 722, and additional memory 724. SCSI host bus adapter 712 provides a connection for hard disk drive 726, tape drive 728, and CD-ROM drive 730. Typical PCI local bus implementations will support three or four PCI expansion slots or add-in connectors.

An operating system runs on processor 702 and is used to coordinate and provide control of various components within data processing system 700 in FIG. 7. The operating system may be a commercially available operating system such as OS/2, which is available from International Business Machines Corporation. "OS/2" is a trademark of International Business Machines Corporation. An object oriented programming system such as Java may run in conjunction with the operating system and provides calls to the operating system from Java programs or applications executing on data processing system 700. "Java" is a trademark of Sun Microsystems, Inc. Instructions for the operating system, the object-oriented operating system, and applications or programs are located on storage devices, such as hard disk drive 726, and may be loaded into main memory 704 for execution by processor 702.

Those of ordinary skill in the art will appreciate that the hardware in FIG. 7 may vary depending on the implementation. Other internal hardware or peripheral devices, such as flash ROM (or equivalent nonvolatile memory) or optical disk drives and the like, may be used in addition to or in place of the hardware depicted in FIG. 7. Also, the processes of the present invention may be applied to a multiprocessor data processing system.

For example, data processing system 700, if optionally configured as a network computer, may not include SCSI host bus adapter 712, hard disk drive 726, tape drive 728, and CD-ROM 730, as noted by dotted line 732 in FIG. 7 denoting optional inclusion. In that case, the computer, to be properly called a client computer, must include some type of network communication interface, such as LAN adapter 710, modem 722, or the like. As another example, data processing system 700 may be a stand-alone system configured to be bootable without relying on some type of network communication interface, whether or not data processing system 700 comprises some type of network communication interface. As a further example, data processing system 700 may be a Personal Digital Assistant (PDA) device which is configured with ROM and/or flash ROM in order to provide non-volatile memory for storing operating system files and/or user-generated data.

The depicted example in FIG. 7 and above-described examples are not meant to imply architectural limitations. For example, data processing system 700 also may be a notebook computer or hand held computer in addition to taking the form of a PDA. Data processing system 700 also may be a kiosk or a Web appliance.

Figures 4, 8:
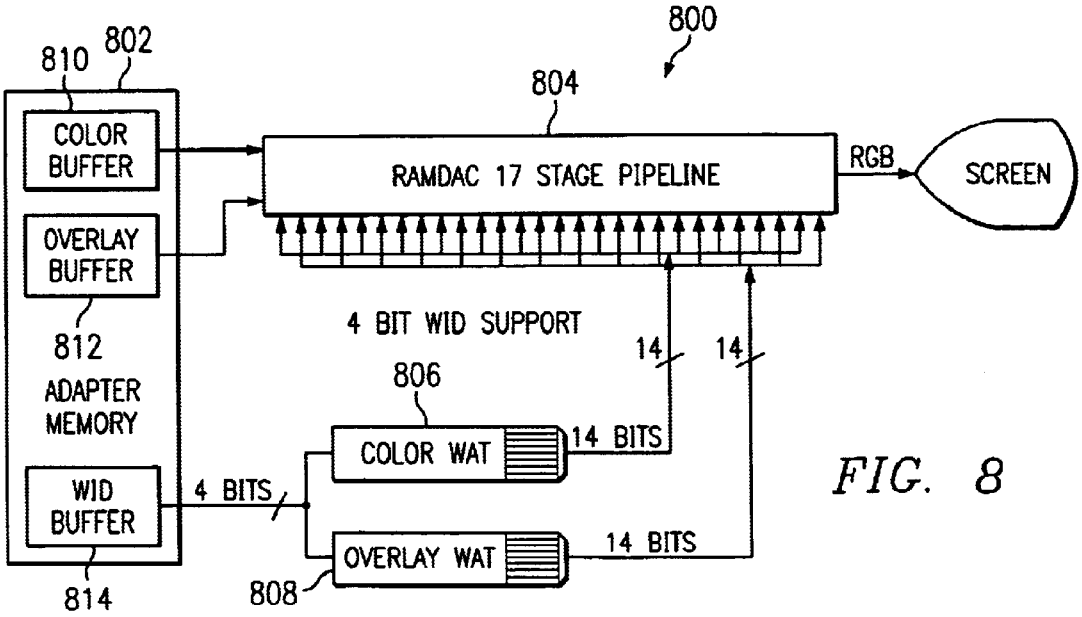
FIG. 4 (PRIOR ART)
FIG. 4 is a WAT table illustrated for a color WAT and an overlay WAT.
FIG. 8 is a block diagram illustrating a graphics adapter in accordance with a preferred embodiment of the present invention.

Turning next to FIG. 8, a block diagram illustrating a graphics adapter is depicted in accordance with a preferred embodiment of the present invention. Graphics adapter 800 is an example of a graphics adapter, such as graphics adapter 718 in FIG. 7. Graphics adapter 800 includes an adapter memory 802, a random access memory digital to analog converter (RAMDAC) 804, a color WAT table 806, and an overlay WAT table 808. Adapter memory 802 includes a color frame buffer 810, an overlay frame buffer 812, and a WID buffer 814. The two frame buffers contain pixels, which are sent to RAMDAC 804 for output to a display device. RAMDAC 804 is a graphics controller chip that maintains the color palette and converts data from memory into analog signals for a display device.

WID buffer 814 contains WIDs that are used as an index into color WAT table 806 and overlay WAT table 808. Each of these WAT tables describes how a pixel will be rendered on a display device. These WAT tables may be implemented using WAT table 400 in FIG. 4. The color WAT entries from WAT table 400 may be implemented in color WAT table 806 in FIG. 8. The overlay entries from WAT table 400 in FIG. 4 may be implemented in overlay WAT table 808 in FIG. 8.

With reference now to FIG. 9, an illustration of an overlay is depicted in accordance with a preferred embodiment of the present invention. In this example, map 900 may be displayed using pixels located in two frame buffers and a single WID buffer. Map 900 includes a set of pixels in a color frame buffer that represent states in map 900. For example, shape 902 is that of the State of Texas. The pixels for shape 902 are located in a color frame buffer, while the text "Texas" 904 is located in an overlay frame buffer. In this example, "Texas" 904 is located in a region 906 in the overlay frame buffer, while shape 902 is located in a region 908 in the color frame buffer. The region where the text is located is opaque, while other portions are transparent.

The present invention provides a method, apparatus, and computer implemented instructions for installing the correct WID values over an entire transparent region. The mechanism of the present invention updates color buffer WIDs in the specified region corresponding to the transparent window region. The rest of the region is then assigned a color WID. This mechanism ensures that the proper WID values are correctly installed for the transparent region or window.

With reference now to FIG. 10, a diagram illustrating a portion of a four bit WID buffer is depicted in accordance with a preferred embodiment of the present invention. Portion 1000 includes a transparent region 1002. In this example, the color buffer WIDs in the region corresponding to transparent region 1002 are updated. The rest of transparent region 1002 is updated with the color WID f using a WAT table, such as WAT table 400 in FIG. 4. The WID entry f in WAT table 400 provides an appropriate color map and tranparent pixel type for the other portions of transparent region 1002. These processes for handling transparent regions may be applied to different windows having a hierarchical relationship.

With reference now to FIG. 11, a diagram illustrating a window tree is depicted in accordance with a preferred embodiment of the present invention. Window tree 1100 is stored within a data structure in a main or host memory of a data processing system. In these examples, window tree 1100 is maintained by an x server. Window tree 1100 includes a root window 1102. Window 1104 and window 1106 are children windows of root window 1102. Window 1104 and window 1106 are called sibling windows in window tree 1100. Windows 1108, 1110, and 1112 are sibling windows to each other and are children windows to window 1104. Window 1114 is a child to window 1108. In this example, window 1102 represents a color or layer 0 window similar to that illustrated in region 908 in FIG. 9. Window 1108, in this example, is an overlay or layer 1 window similar to region 906 in FIG. 9. The other windows may be either layer 0 or layer 1 windows as shown in FIG. 11. With these different windows in window tree 1100, the present invention will identify the parent or root window, as well as processing the different overlay windows.

With reference now to FIG. 12, a flowchart of a process for installing correct WIDs over an entire transparent region is depicted in accordance with a preferred embodiment of the present invention. This process may be used for installing correct WIDs, such as those for a color map and transparent pixel type over a transparent region.

The process begins by determining whether the window is a transparent window (step 1200). If the window is a transparent window, the color WIDs for the exposed region are updated (step 1202). Step 1202 is discussed in more detail below in the description of FIG. 13. The remaining overlay regions are updated with a color WID for the exposed region (step 1204) with the process terminating thereafter.

With reference again to step 1200, if the window is not a transparent window, the WID for the exposed regions is updated (step 1206) with the process terminating thereafter.

Figure 13:
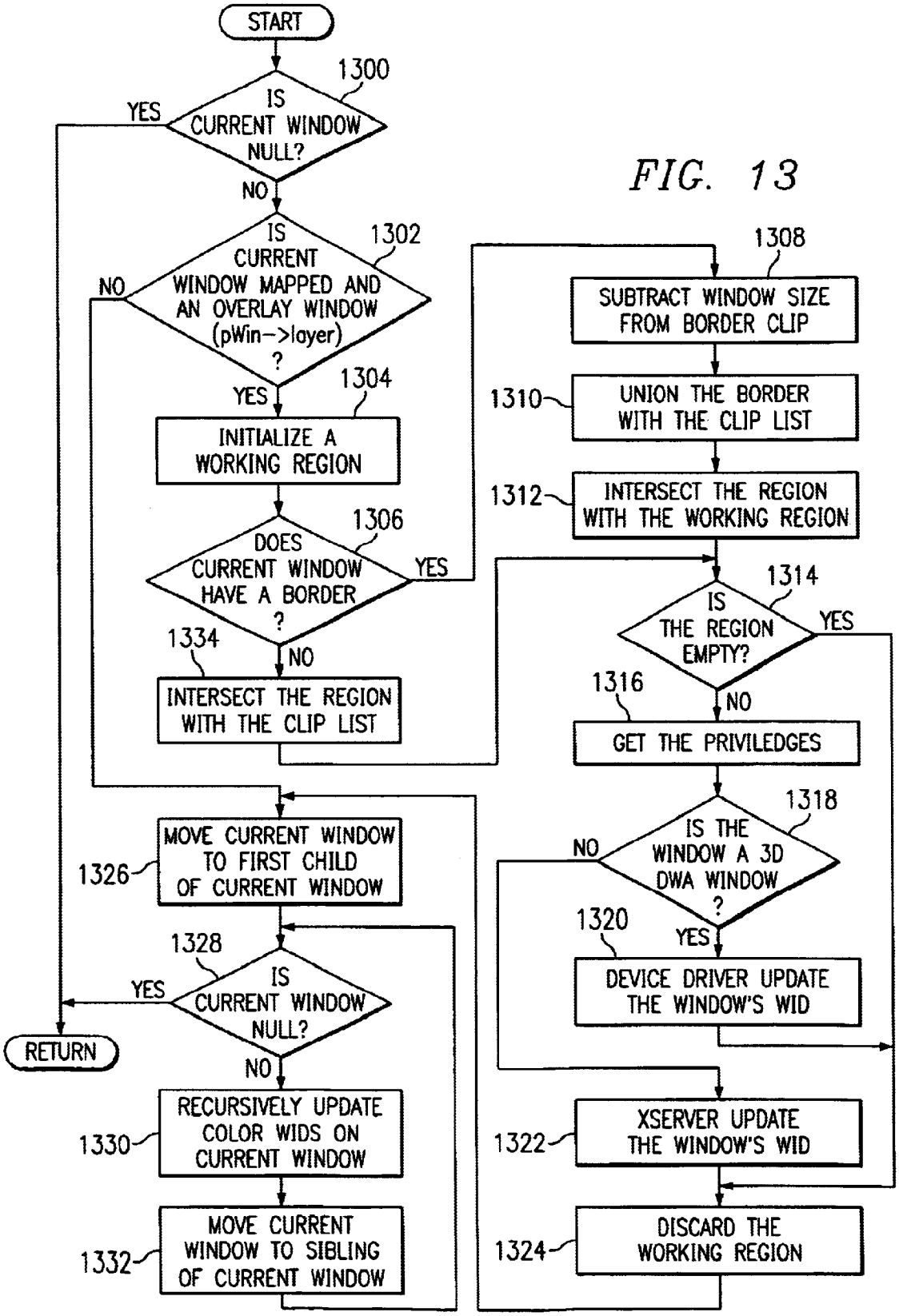
FIG. 13 is a flowchart of a process for updating color WIDs in accordance with a preferred embodiment of the present invention.

Turning next to FIG. 13, a flowchart of a process for updating color WIDs is depicted in accordance with a preferred embodiment of the present invention. The process illustrated in FIG. 13 is used to update color WIDs in a particular region. In this example, the process updates color WIDs for a transparent region. This process is also called a UpdateColorWIDS function and is a more detailed description of step 1202 in FIG. 12.

The process begins by determining whether the current window is null (step 1300). This step determines whether the pointer is to the root window. If the current window is null, the process terminates. Otherwise, a determination is made as to whether the current window is mapped and whether the current window is an overlay window (step 1302). If a window is mapped, it may be viewable. Unmapped windows are never viewable. If the current window is mapped and is an overlay window, a working region is initialized (step 1304).

Next, A determination is made as to whether the current window has a border (step 1306). A bordered window is a window that contains a rectangular region larger than the window, so that the window is inside the border region. If the current window has a border, it is a bordered window. The window size is subtracted from the border clip (step 1308). The border clip contains the viewable portion of the border after all clipping has been completed. Since the border clip contains the border and everything within it, the window size has to be subtracted to obtain the border region. Next, the border is unioned with the clip list (step 1310). The working region is then intersected with the region (step 1312). The region intersected with the clip list in step 1312 is the transparent region passed to the process in FIG. 12.

Next, a determination is made as to whether the region is empty (step 1314). Once the transparent region is intersected with the working region, the region can be checked to see if it is an empty region. An empty region is defined when the number of rectangles that make up the region is equal to zero.

If the region is not empty, the privileges are obtained (step 1316). These priviledges are for a private structure created by the device dependent X (ddx) code and is obtained from the current window. This private stucture can be found from the devPrivates field in the WindowRec structure. With the priviledges, the structure can be accessed. The present invention is described with reference to X, which is also referred to as X Windows or X Window System. X is a windowing system, which runs under UNIX and all major operating systems. X lets users run applications on other computers in the network and view the output on their own screen. X generates a rudimentary window that can be enhanced with GUIs, such as Open Look and Motif, but does not require applications to conform to a GUI standard. The window manager component of the GUI allows multiple resizable, relocatable X windows to be viewed on screen at the same time. X client software resides in the computer that performs the processing and X server software resides in the computer that displays it. Both components can also be in the same machine.

A determination is made as to whether the window is a 3 dimensional DWA window (step 1318). A 3 dimensional Direct Window Access (DWA) allows graphics standards, such as OpenGL and graPHIGS, to have access to the window directly. The 3 dimensional API does not have to go through X in order to render. DWA is supported by AIX, which is available from International Business Machines Corporation. The device driver updates the WIDS for DWA windows so a call must be made to the device driver to update the WID if necessary.

If the window is a 3 dimensional DWA window, the device driver updates the window's WID (step 1320). A call is made to the device driver to update the WID associated with the window. The Window Geometry, which includes, for example, the clip region, WID value, WID region, is passed to the device driver so the WID can be updated. The device driver performs this update by rendering the WID value to the WID buffer in the WID region.

Otherwise, the X server updates the window's WID (step 1322). X updates the WIDs for all non DWA windows. The WID is updated by rendering the WID region to the WID buffer. In either case, the working region is then discarded (step 1324).

Then, the current window is moved to the first child window of the current window (step 1326). This step is used to select the next window for processing. A determination is made as to whether the current window is null (step 1328). If the current window is null, the process terminates. Otherwise, color WIDs for the current window are recursively updated (step 1330). Step 1330 is a recursive step used to represent an entry into another process starting with step 1300. Thereafter, the current window is moved to a sibling of the current window (step 1332) with the process then returning to step 1328.

With reference again to step 1314, if the region is empty, the process proceeds to step 1324 as described above. Turning back to step 1306, if the current window does not have a border, the region is intersected with the clip list (step 1334). This region is the region originally passed to the process in FIG. 11. The process then proceeds to step 1314 as described above.

With referene to step 1302, if the current window is not both a mapped window and an overlay window the process proceeds to step 1326.

Turning next to FIG. 14, a diagram of code used to update color WIDs in a transparent window region is depicted in accordance with a preferred embodiment of the present invention. Code 1400 will call the process illustrated in FIG. 13 to update color WIDs if the WID is a transparent WID. If any regions are present that have not been updated to a color WID, a maximum color WID value is assigned, so that the transparent region will have the correct color map. For example, a WID f may be assigned from table 400 in FIG. 4 for these regions by code 1400.

With reference now to FIGS. 15A and 15B, diagrams illustrating an updated color WID function are depicted in accordance with a preferred embodiment of the present invention. In this example, code 1500 is written in C. Code 1500 will update all color WIDs that intersect the region. In particular, code 1500 will traverse the parent window, as well as all of the siblings and children of the parent window to update the color WIDs that intersect the region. In code 1500, while windows in a window tree are being traversed, a window in the color plane is mapped to the screen, border and clip list regions are unioned together and then intersected with the specified region. If the region is not empty in these examples, and the window is a DWA window, then the device driver updates the WID. Otherwise, if the window is a non DWA window, the x server will update the WID.

It is important to note that while the present invention has been described in the context of a fully functioning data processing system, those of ordinary skill in the art will appreciate that the processes of the present invention are capable of being distributed in a form of a computer readable medium of instructions and a variety of forms and that the present invention applies equally regardless of the particular type of signal bearing media actually used to carry out the distribution. Examples of computer readable media include recordable-type media such a floppy disc, a hard disk drive, a RAM, CD-ROMs, and transmission-type media such as digital and analog communications links.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A method in a data processing system for updating a buffer containing display information used to display pixels from a first layer and a second layer on a display in the data processing system, the method comprising the data processing system implemented steps of:

identifying pixels from the first layer and pixels from the second layer in a transparent region;

updating the display information in the buffer for pixels in the first layer in the transparent region; and assigning correct display information to pixels in the second layer in the transparent region.

2. The method of claim 1, wherein the display information is a set of window identifiers.

3. The method of claim 2, wherein the set of window identifiers serve as an index into a window attribute table used to display the pixels.

4. The method of claim 2, wherein the display information includes a set of color maps.

5. The method of claim 4, wherein the correct display information is a selected color map from the set of color maps.

6. The method of claim 1, wherein the pixels in the first layer are color pixels and the pixels in the second layer are overlay pixels.

7. The method of claim 5, wherein the color pixels are stored in a first frame buffer and the overlay pixels are stored in a second frame buffer.

8. The method of claim 5, wherein the display information includes an identification of color maps used to display the color pixels and the overlay pixels.

9. A method in a data processing system for updating a buffer containing window identifiers used to display pixels from a first layer and a second layer on a display in the data processing system, the method comprising the data processing system implemented steps of:

identifying a transparent region;

updating window identifiers for pixels in the first layer in the transparent region; and assigning predefined window identifiers to pixels in the second layer in the transparent region.

10. The method of claim 9, wherein the window identifiers serve as an index into a window attribute table used to display the pixels in the first layer and the pixels in the second layer.

11. The method of claim 9, wherein the first layer is a color layer and the second layer is an overlay layer.

12. A display apparatus comprising:

a first frame buffer for storing a first set of pixels;

a second frame buffer for storing a second set of pixels;

a first window attribute table storing display information;

a second window attribute table storing display information;

a window identifier buffer connected to the first window attribute table and the second window attribute table, wherein the window identifier buffer stores window identifiers used to identify display information for the first set of pixels and for the second set of pixels;

a random access memory digital to analog converter unit connected to the first frame buffer, the second frame buffer, the first window attribute table, and the second window attribute table and having a connection configured to connection to a display device, wherein the random access memory digital to analog converter unit receives pixels for display from the first frame buffer and the second frame buffer and displays the pixels using display information from the first window attribute table and the second window attribute table; and a processing unit, wherein the processing unit identifies a transparent region, updates window identifiers in the window identifier buffer for pixels in the first frame buffer in the transparent region, and assigns window identifiers in the window identifier buffer for pixels in the second frame buffer in the transparent region.

13. The display apparatus of claim 12, wherein the display apparatus is a graphics adapter and wherein the processing unit is a processor located on the graphics adapter.

14. The display apparatus of claim 12, wherein the display apparatus is a computer and wherein the first frame buffer, the second frame buffer, the first window attribute table, the second window attribute table, and the window identifier buffer are located in a graphics adapter in the computer and the processing unit is a central processing unit in the computer.

15. A data processing system for updating a buffer containing display information used to display pixels from a first layer and a second layer on a display in the data processing system, the data processing system comprising:

identifying means for identifying pixels from the first layer and pixels from the second layer in a transparent region;

updating means for updating the display information in the buffer for pixels in the first layer in the transparent region; and assigning means for assigning correct display information to pixels in the second layer in the transparent region.

16. The data processing system of claim 15, wherein the display information is a set of window identifiers.

17. The data processing system of claim 16, wherein the set of window identifiers serve as an index into a window attribute table used to display the pixels.

18. The data processing system of claim 16, wherein the display information includes a set of color maps.

19. The data processing system of claim 18, wherein the correct display information is a selected color map from the set of color maps.

20. The data processing system of claim 15, wherein the pixels in the first layer are color pixels and the pixels in the second layer are overlay pixels.

21. The data processing system of claim 19, wherein the color pixels are stored in a first frame buffer and the overlay pixels are stored in a second frame buffer.

22. The data processing system of claim 19, wherein the display information includes an identification of color maps used to display the color pixels and the overlay pixels.

23. A data processing system for updating a buffer containing window identifiers used to display pixels from a first layer and a second layer on a display in the data processing system, the data processing system comprising:

identifying means for identifying a transparent region;

updating means for updating window identifiers for pixels in the first layer in the transparent region; and assigning means for assigning predefined window identifiers to pixels in the second layer in the transparent region.

24. The data processing system of claim 23, wherein the window identifiers serve as an index into a window attribute table used to display the pixels in the first layer and the pixels in the second layer.

25. The data processing system of claim 23, wherein the first layer is a color layer and the second layer is an overlay layer.

26. A computer program product in a computer readable medium for updating a buffer containing display information used to display pixels from a first layer and a second layer on a display in the computer program product, the computer program product comprising:

first instructions for identifying pixels from the first layer and pixels from the second layer in a transparent region;

second instructions for updating the display information in the buffer for pixels in the first layer in the transparent region; and third instructions for assigning correct display information to pixels in the second layer in the transparent region.

27. A computer program product in a computer readable medium for updating a buffer containing window identifiers used to display pixels from a first layer and a second layer on a display in the computer program product, the computer program product comprising:

first instructions for identifying a transparent region;

second instructions for updating window identifiers for pixels in the first layer in the transparent region; and third instructions for assigning predefined window identifiers to pixels in the second layer in the transparent region.

* * * * *